US005841333A

United States Patent [19]

Fishburn et al.

[11] Patent Number: 5,841,333

[45] Date of Patent: Nov. 24, 1998

[54] MINIMAL DELAY CONDUCTIVE LEAD LINES FOR INTEGRATED CIRCUITS

[75] Inventors: John Philip Fishburn, Murray Hill, N.J.; Catherine Anne Schevon, Philadelphia, Pa.

[73] Assignee: Lucent Technologies, Murray Hill, N.J.

[21] Appl. No.: 756,695

[22] Filed: Nov. 26, 1996

[51] Int. Cl.[6] ..... H01P 3/08

[52] U.S. Cl. ..... 333/238; 333/246

[58] Field of Search ..... 333/24 R, 34, 333/161, 238, 246

[56] References Cited

U.S. PATENT DOCUMENTS

| | | | |
|---|---|---|---|
| 3,323,082 | 5/1967 | Kenneally | 333/34 |
| 3,419,813 | 12/1968 | Kamnitsis | 333/34 X |
| 4,539,528 | 9/1985 | Bayraktaroglu et al. | 333/34 X |
| 5,656,873 | 8/1997 | O'Loughlin et al. | 333/34 X |

*Primary Examiner*—Paul Gensler
*Attorney, Agent, or Firm*—Mathews, Collins, Shepherd & Gould, P.A.

[57] ABSTRACT

In accordance with the invention, a conductive lead line extending between a source and a capacitance load has a width w(x) which is a function of the distance x. For many practical applications such as leads for multichip modules, w(x) can be taken as the exponential function of the distance from the load given by the equation below. For many applications w(x) can be adequately approximated by the first three terms of a power series representation:

$$w(x) \approx W_o + \frac{W_0(2C_sW_0)}{2C_0}x + \frac{W_O(4C_s^2W_o^2)}{8C_o^2}x^2$$

where $W_0$ is the width of the lead line at x=0, $C_0$ is the load capacitance and $C_0$ is the area capacitance. For VLSI applications w(x) is a friction which can be designated≠E ($W_0$, $C_0$, $C_p$, $C_S$, x) where $C_p$ is the perimeter capacitance. E($W_0$, $C_0$, $C_p$, $C_S$, x) is derived herein. For most practical applications, w(x) can be adequately approximated by the first three terms:

$$w(x) \approx W_o + \frac{W_o(2C_sW_o + C_p)}{2C_o}x + \frac{W_o(4C_s^2W_o^2 - C_p^2)}{8C_o^2}x^2$$

In contrast with optimal-width rectangular wire, the RC Elmore delay of the optimally tapered lead goes to zero as the driver resistance approaches zero.

9 Claims, 6 Drawing Sheets

MINIMAL DELAY CONDUCTIVE LEAD LINES FOR INTEGRATED CIRCUITS

FIELD OF THE INVENTION

This invention relates to conductive lead lines for integrated circuits and, in particular, to conductive lead lines for propagating an electrical signal with minimal delay.

BACKGROUND OF THE INVENTION

Integrated circuits use thin, rectangular cross-section conductive lead lines to electrically interconnect electronic components and even subsystems of complex electronic devices such as microprocessors. These lead lines, which are typically of uniform width, are not instantaneous. They introduce small, finite delays between the source (usually a driving resistor) at one end and the load (usually a lumped capacitance) at the other end. These delays make up a significant portion of delay in integrated circuits. Moreover they assume increasing importance in complex VLSI systems, such as microprocessors, which synchronize the operations of many subsystems by delivery over leads of a common timing signal. Accordingly there is a need for conductive lead lines for integrated circuits which will minimize delay.

SUMMARY OF THE INVENTION

In accordance with the invention, a conductive lead line extending between a source and a capacitance load has a width w(x) which is a function of the distance x. For many practical applications such as leads for multichip modules, w(x) can be taken as the exponential function of the distance from the load given by Equation (7) below. For many applications w(x) can be adequately approximated by the first three terms of a power series representation:

$$w(x) \approx W_o + \frac{W_0(2C_sW_0)}{2C_0}x + \frac{W_O(4C_s^2W_o^2)}{8C_o^2}x^2$$

where $W_0$ is the width of the lead line at x=0, $C_0$ is the load capacitance and $C_S$ is the area capacitance. For VLSI applications w(x) is a function which can be designated≠E ($W_0$, $C_0$, $C_p$, $C_S$, x) where $C_p$ is the perimeter capacitance. E($W_0$, $C_0$, $C_p$, $C_S$, x) is derived below as Equation (5). For most practical applications, w(x) can be adequately approximated by the first three terms of Eq. (5):

$$w(x) \approx W_o + \frac{W_o(2C_sW_o + C_p)}{2C_o}x + \frac{W_o(4C_s^2W_o^2 - C_p^2)}{8C_o^2}x^2$$

In contrast with optimal-width rectangular wire, the RC Elmore delay of the optimally tapered lead goes to zero as the driver resistance approaches zero.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

Figure 1:
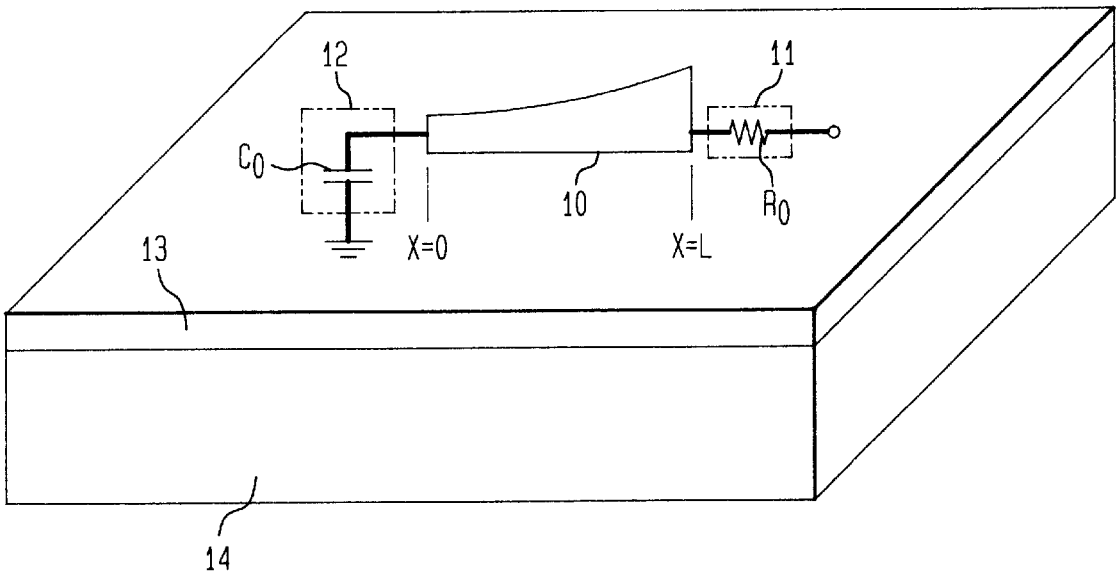
FIG. 1 is a schematic diagram of a conductive lead line in accordance with the invention.

It is to be understood that these drawings are for purposes of illustrating the concepts of the invention and that FIG. 1 is not to scale.

DETAILED DESCRIPTION

This specification is divided into two parts. Part I describes the minimal delay conductive lead lines of the invention, and part II—which is useful for extensions of the inventive concept—describes the derivation of the minimal delay design and compares it with other designs.

I. Minimal Delay Lead Line Designs

While no electrical signal can travel faster than the speed of light, a portion of the delay due to the RC characteristics of a lead line can be minimized. This portion of the delay, referred to as the RC Elmore delay, can be reduced in a lead by properly varying the width w as a function of the distance x between source and load.

The present applicant has previously reported that the optimal width function for minimizing Elmore delay of a distributed RC-wire can be approximated by an exponential taper See J. P. Fishburn et al., "Shaping a distributed -RC line to minimize Elmore delay", *IEEE Transactions on CAS-I,* 42: 1020–1022 (December 1995) which is incorporated herein by reference. A similar conclusion was subsequently reported by C. P. Chen et al., "Optimal wire-sizing formula under the Elmore delay model", *Design Automation Conference,* pp. 487–490 (1996). In both these works zero perimeter capacitance was assumed, so the wire capacitance was assumed to be due-entirely to area capacitance.

The assumption of zero perimeter capacitance is justifiable for multi-chip modules (MCMs), where wire width is much greater than wire thickness. However minimum feature size has continually decreased in VLSI to the point where minimum wire width is now considerably smaller than wire thickness, and thus area capacitance is less than perimeter capacitance. At the same time, the smaller geometries yield transistors with greater drive current, and less gate and source/drain capacitance, so that wire design becomes increasingly important.

Referring to the drawings, FIG. 1 schematically illustrates a circuit including a minimal delay conductive lead line 10 comprising a thin film of substrate-supported conductive Material extending between a signal source 11 and a load 12. The terms "lead" and lead line" as used herein is intended to cover the thin substrate-supported conductive elements used in printed and integrated circuits to electrically interconnect electrical and electronic components. They encompass signal lines, strip lines, Land microstrip signal traces. For convenience of reference, the longitudinal extent of the lead line can be measured along a dimension x extending from the load 12 defined as x=0 to the source 11 at x=L. The optimal width of the line for minimizing Elmore delay is w(x), a function of x.

In practical application, the lead line is typically a film of metal, such as aluminum, supported on a dielectric layer 13 disposed on a semiconductor substrate 14. Typical film, thickness is in the range 0.5–2 micrometers, typical widths are 0.5 micrometers and greater, and typical lengths are 2–50 mm.

The source 11 is dominantly characterized by a driver resistance R0, typically less than 500Ω, and the load 12 is typically characterized by a load capacitance C0 of 0.1 picofarad or more.

Pertinent parameters of the lead line are its unit area capacitance $C_S$, its unit perimeter capacitance $C_p$ its width $W_0$ at the load, and its sheet resistance $R_S$.

For minimal Elmore delay in applications such as multichip modules (MCMs) where the area capacitance $C_S$ is large compared to the perimeter capacitance, the variation of lead line width w as a function of distance x from the load is given by the exponential function given below as Equation 7. For many applications, w(x) can be approximated by the first three terms of a power series representation of Eq. (7):

$$w(x) \approx W_o + \frac{W_0(2C_sW_0)}{2C_0}x + \frac{W_O(4C_s^2W_o^2)}{8C_o^2}x^2$$

For very large scale integrated circuits (VLSI), the minimum width of the lead lines is less than or equal to their thickness, and the effect of lead perimeter capacitance cannot be neglected.

For minimal Elmore delay taking perimeter capacitance into account, the variation of lead line width w(x) is given by Equation. (5) below. For many applications w(x) can be taken as the first three terms of Eq. (5):

$$w(x) \approx W_o + \frac{W_o(2C_sW_o + C_p)}{2C_o}x + \frac{W_o(4C_s^2W_o^2 - C_p^2)}{8C_o^2}x^2$$

Lead lines in accordance with this design can be readily fabricated using conventional techniques. A thin film of metal can be deposited on a dielectric surface, and the film can be formed into the desired pattern using photolithographic techniques well known in the art.

The preferred use of the minimal delay lead line is to form a clock signal distribution network for high performance microprocessors such as in the network described by M. P. Desai et al., "Sizing of clock distribution networks for high performance CPU chips", 33rd Design Automation Conference, Las Vegas (June 1996) which is incorporated herein by reference.

The derivation of this design as well as its advantages over previous designs are set forth in detail below.

II. Derivation And Advantages of the Design

The derivation of the minimal delay exponential taper is set forth in applicants aforementioned article of December 1995 which has been incorporated by reference. Here applicant will extend the design to take into account the effects of the perimeter capacitance.

Euler's differential equation of the calculus of variations is used to determine the shape of a VLSI wire that minimizes Elmore delay. The wire is assumed to have distributed area and perimeter capacitance, distributed resistance, a lumped capacitance load at one end, and a driving resistor at the other. The solution is given as a power series whose coefficients are formulas involving the load-end wire width, the load capacitance, the capacitance per unit area, and the capacitance per unit perimeter. In contrast to an optimal-width rectangular wire, the RC Elmore delay of the optimally tapered wire goes to zero as the driver resistance goes to zero. The optimal taper is immune, to first order, to process variations affecting wire width.

Figure 2:
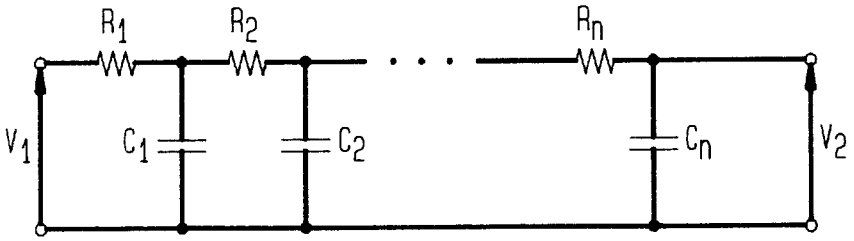
FIG. 2 is a diagram of an RC ladder network useful in describing Elmore delay.

The Elmore delay of a linear-network is defined to be the first moment of the network impulse response. For example, if a unit impulse is applied to the input $V_1$ of FIG. 2 at t=0, the Elmore delay is defined as $\int_0^\infty tV_2(t)dt$, which is the x-coordinate of the center of gravity of the region under the impulse response. In the case of an RC ladder, this is equal to the sum, over all the resistors, of that resistance times all its downstream capacitance. In FIG. 2, $$ED = \int_0^\infty tV_2(t)dt = R_1(C_1 + \ldots + C_n) + R_2(C_2 + \ldots + C_n) + \ldots + R_nC_n \tag{1}$$

For a given voltage threshold, the Elmore delay can be multiplied by appropriate constants to give upper and lower bounds for the time that it takes an RC ladder output to cross the threshold, in response to a step input. Elmore delay has been shown to be identical with group delay at zero frequency. It has been found empirically that if the input and output are at opposite ends of the network, the 50% step response delay is usually within 3% of 0.7533 times Elmore delay. Another empirical study found that optimization of interconnect according to an Elmore delay objective function leads to more nearly optimal actual delay than would be expected merely on the basis of the Elmore model accuracy. For these reasons, Elmore delay has been widely used to estimate delays in VLSI logic gates and interconnect.

It is assumed that a planar wire length L is driven with resistance $R_0$, and drives a capacitance to ground $C_0$. The resistance per square is $R_S$ and capacitance per unit area is denoted by $C_S$. It is assumed that the wire taper is gradual enough that perimeter capacitance can be modeled as proportional to wire length. We will denote the proportionality constant by $C_p$. Since this constant includes both sides of the wire, it is 2 times what is usually referred to as perimeter capacitance. If the wire width at x is given by w(x), the Elmore delay (1) is then $$ED = R_0\left(C_0 + C_pL + \int_0^L C_sw(x)dx\right) + \int_0^L \frac{R_s\left(C_0 + C_px + \int_0^x C_sw(l)dl\right)}{w(x)}dx \tag{2}$$

or $$ED = R_0(C_0 + C_pL) + \int_0^L R_0C_sw(x) + \frac{R_s\left(C_0 + C_px + C_s\int_0^x w(l)dl\right)}{w(x)}dx$$

If we define $u(x)=\int_0^x w(l)dl$ then $u'(x)=w(x)$, and Euler's equation for minimizing equation (2) is $$0=2C_S(u'(x))^2+C_pu'(x)-2u''(x)(C_0+C_px+C_Su(x)) \quad (3)$$

This differential equation can be solved with a power series as follows: Suppose that $$u(x)=\sum_{n=0}^{\infty} a_nx^n \quad (4)$$

Due to the definition of u(x), $a_0=u(0)=0$. $a_1$ is the width of the wire at x=0, which we denote by the special name $W_0$. Substituting (4) into equation (3), we obtain the following power series.

$$\begin{aligned}0 = {} & 2C_sW_o^2 + C_pW_o - 4C_oa_2 + 2(-C_pa_2 + 2C_sW_oa_2 - 6C_oa_3)x + \\ & (4a_2^2C_s - 24C_oa_4 - 9C_pa_3)x^2 - \\ & 4(-2C_sa_2a_3 + 10C_oa_5 + 5C_pa_4 + 2C_sW_oa_4)x^3 - \\ & (20C_sW_oa_5 - 4C_sa_2a_4 - 6C_sa_3^2 + 35C_pa_5 + 60C_oa_6)x^4 - \\ & 2(27C_pa_6 + 18C_sW_oa_6 + 2C_sa_2a_5 - 6C_sa_3a_4 + 42C_oa_7)x^5 + \ldots\end{aligned}$$

Since this series is identically zero for all x, each one of its coefficients must also be zero. Hence we can derive closed form expressions for all of the $a_n$ in terms of $W_0=a_1$ as follows: The first coefficient is zero, which allows $a_2$ to be expressed in terms of $W_0=a_1$. If we have closed form expressions for $a_1$ through $a_n$, we can substitute them into the coefficient of $x^{n-1}$, then solve for $a_{n+1}$. In this way we can find the power series coefficients for u(x). Differentiating this power series gives the power series for w(x).

$$\begin{aligned}w(x) \equiv u'(x) = {} & W_0 + \frac{W_o(2C_sW_o + C_p)}{2C_o}x + \frac{W_o(4C_s^2W_o^2 - C_p^2)}{8C_o^2}x^2 + \\ & \frac{W_o(8C_s^3W_o^3 - 4C_s^2W_o^2C_p + 2C_sW_oC_p^2 + 3C_p^3)}{48C_o^3}x^3 + \\ & \frac{W_o(16C_s^4W_o^4 - 16C_s^3W_o^3C_p + 8C_p^2C_s^2W_o^2 - 20C_sW_oC_p^3 - 15C_p^4)}{384C_o^4}x^4 + \\ & \frac{W_o(32C_s^5W_o^5 - 48C_s^4W_o^4C_p + 48C_s^3W_o^3C_p^2 + 40C_s^2W_o^2C_p^3 + 210C_sW_oC_p^4 + 105C_p^5)}{3840C_o^5}x^5 + \ldots\end{aligned}$$

Typical values for the parameters in the above equation are:

TABLE 1

Wire parameters

| Parameter | Value | Description |
|---|---|---|
| $C_0$ | $4 \times 10^{-12}$ Farads | load capacitance |
| $C_s$ | $6.20 \times 10^{-17}$ Farads micrin$^{-2}$ | area capacitance |
| $C_p$ | $11.89 \times 10^{-17}$ Farads micron$^{-1}$ | perimeter capacitance |
| $R_s$ | 0.09 Ω/square | sheet resistance |
| $R_o$ | 25 Ω | driver resistance |
| L | 30700 micron | line length |

The differential equation (3) has a unique solution. We will denote by $$E(W_0, C_0, C_p, C_S, x),$$

or the Elmore taper function, the derivative u'(x) of the solution u(x) of (3) satisfying u(0)=0 and $u'(0)=W_0$, whose power series is given by (5).

The ratio test stipulates that the radius of convergence of (4) is $\lim_{n\to\infty}|a_n/a_{n+1}|$. When $C_p=0$, the power series becomes the series of an exponential function $ae^{bx}$, in which case the series converges for all x. For non-zero $C_p$, the term in $a_n$ containing $C^n_p$ is $$\frac{(-1)(-3)(-5)\cdots(3-2n)C_p^n}{2^n n! C_0^n}$$

and it is this term that seems to determine convergence: The power series converges for all x in the region $[0,C_0/C_p]$. This is an intuitively satisfying result, since $C_0$ "outweighs" the perimeter capacitance only for x inside this interval. This region of convergence has also been observed empirically.

The power series for w(x) has one parameter, $W_0$, that is not given by the original problem. The total Elmore delay, ED, can be expressed as a function of $W_0$ by substituting the power series for u(x) and w(x) into (3) and symbolically or numerically integrating. A golden section search then finds the value of $W_0$ that results in minimum delay.

In the following examples, unless specified otherwise, parameters take on the values in Table 1. The values for $C_S$, $C_p$ and $R_S$ are for a 0.35-micron process. L is one-half the perimeter of the DEC Alpha chip.

Figure 3:
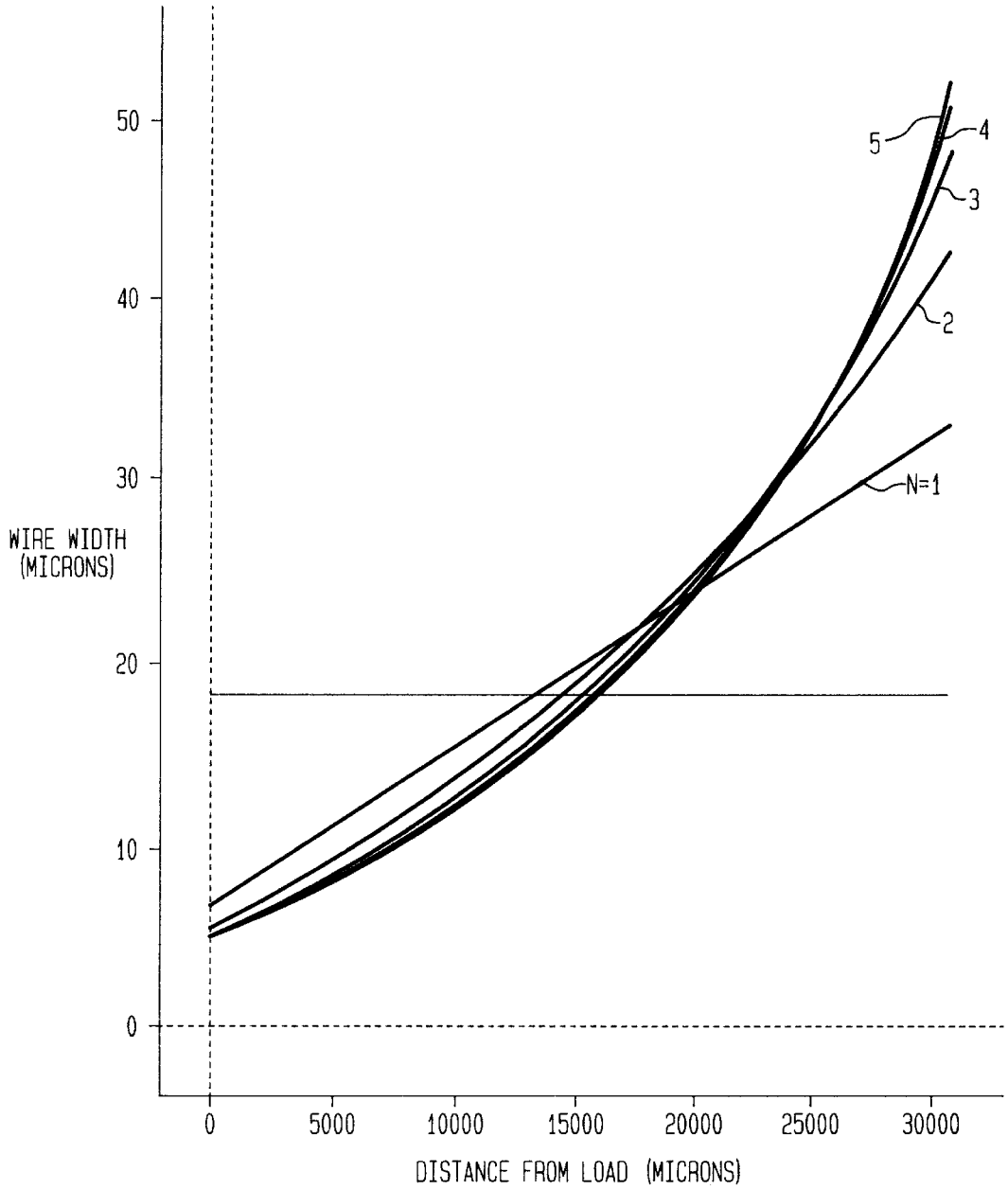
FIG. 3 is a graphical plot of optimal wire width versus distance from the load for six different order power series approximations of the optimal wire.

FIG. 3 shows the wire converging to its optimal shape as the order N of the polynomial approximation increases from 0 to 5. For each value of N, $W_0$ is set to the value that minimizes delay. Thus when N=0, $W_0$ is set to the optimal width for a rectangular-width wire.

Figure 4:
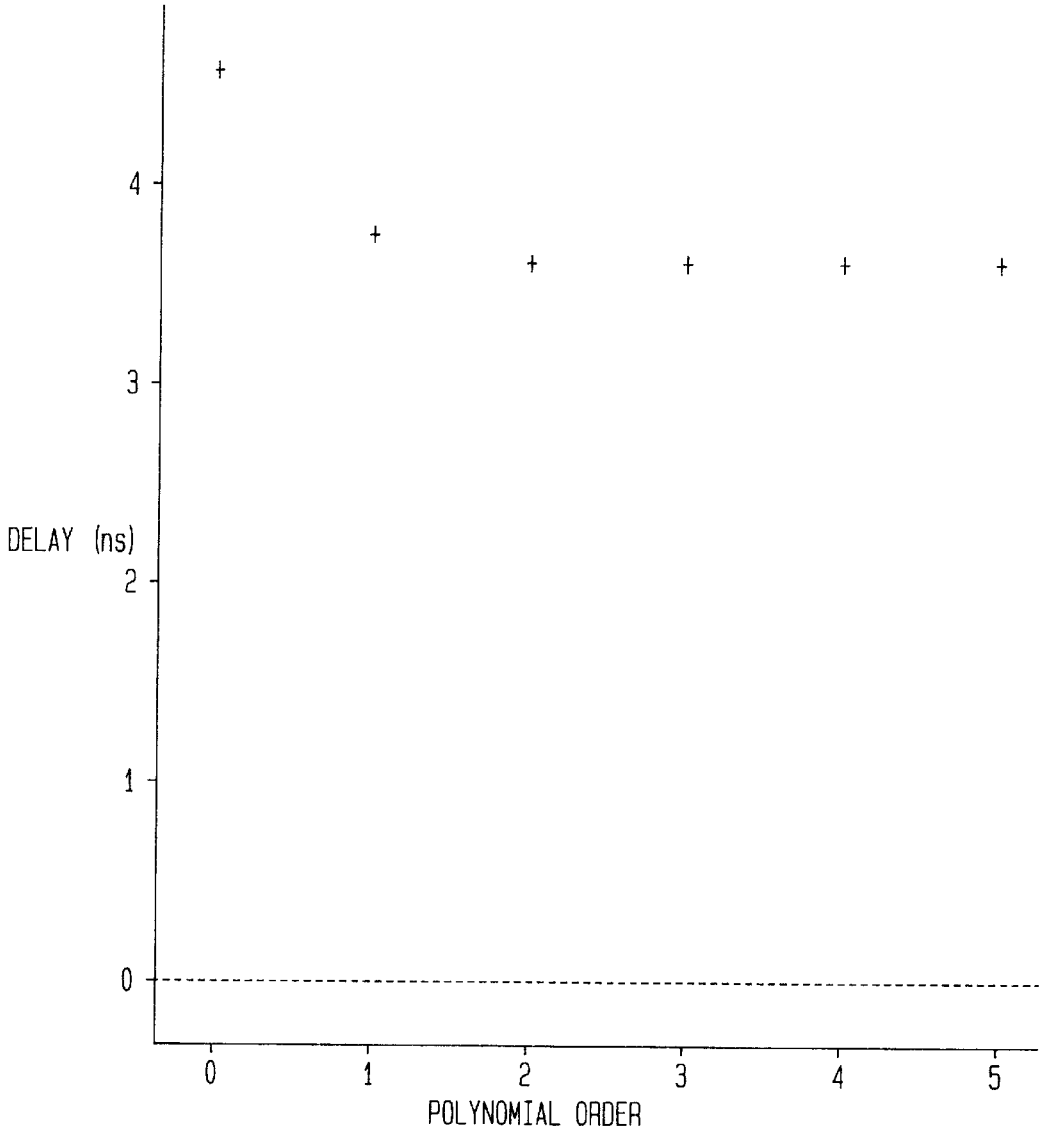
FIG. 4 plots the delay for the six wires of FIG. 3.

FIG. 4 shows the decrease in delay as the order N for the polynomial approximating the power series for w(x) increases. N=0 (optimal-width rectangular wire) is significantly slower than the others, but there is no significant decrease for order greater than 3.

Figure 5:
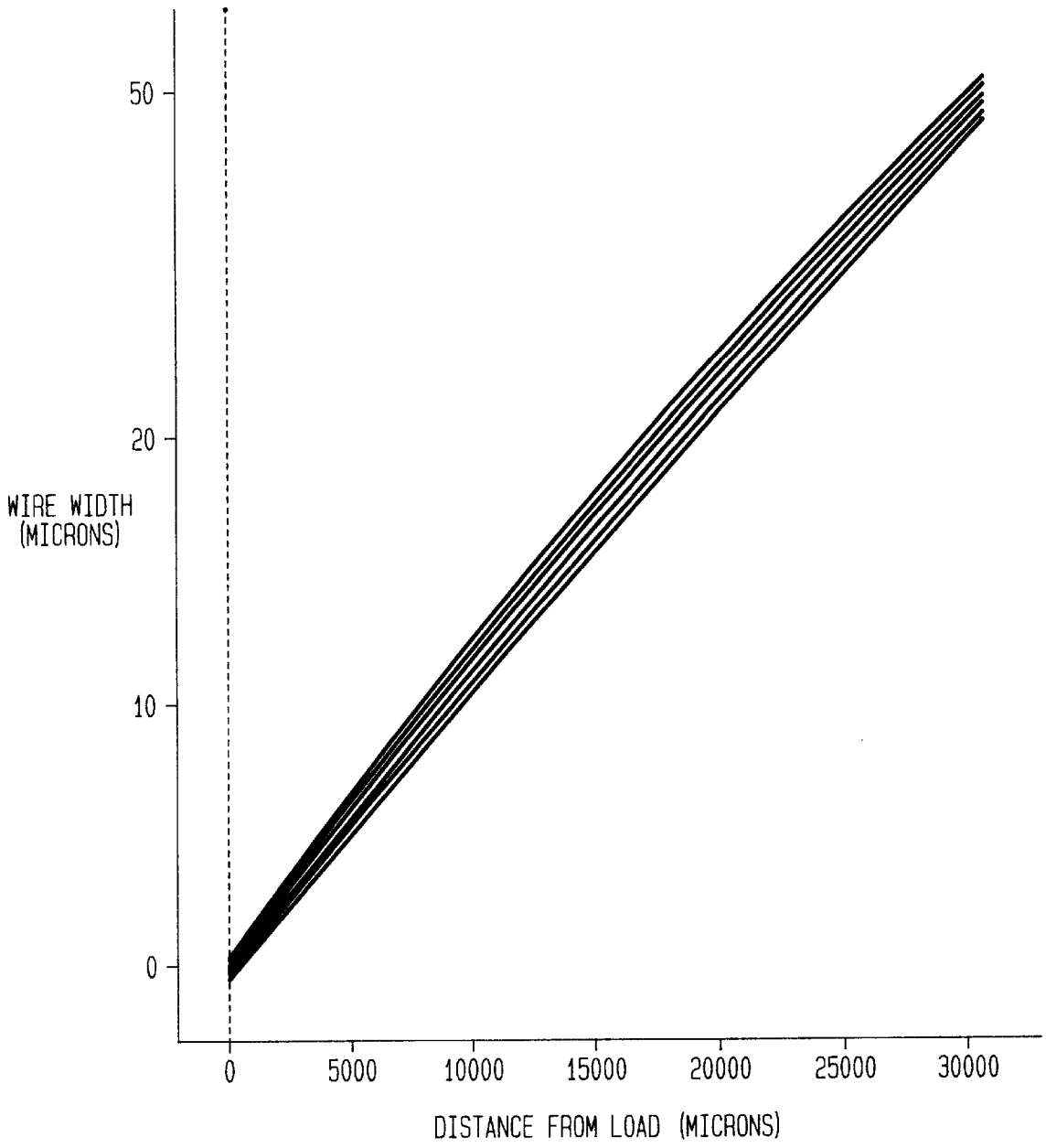
FIG. 5 is a log plot of the shapes of optimal wires for increasing values of $C_p$.

FIG. 5 shows the effect on the optimal taper as $C_p$ grows in equal increments from zero to the value in Table 1. When $C_p=0$, the optimal taper is exponential, so the taper is a straight line on this log scale. When $C_p>0$, the width at the load end grows faster than the original exponential curve. But as the wire becomes wider toward the driver end, area capacitance once again dominates over perimeter capacitance, and the wire grows at a slower rate.

Figure 6:
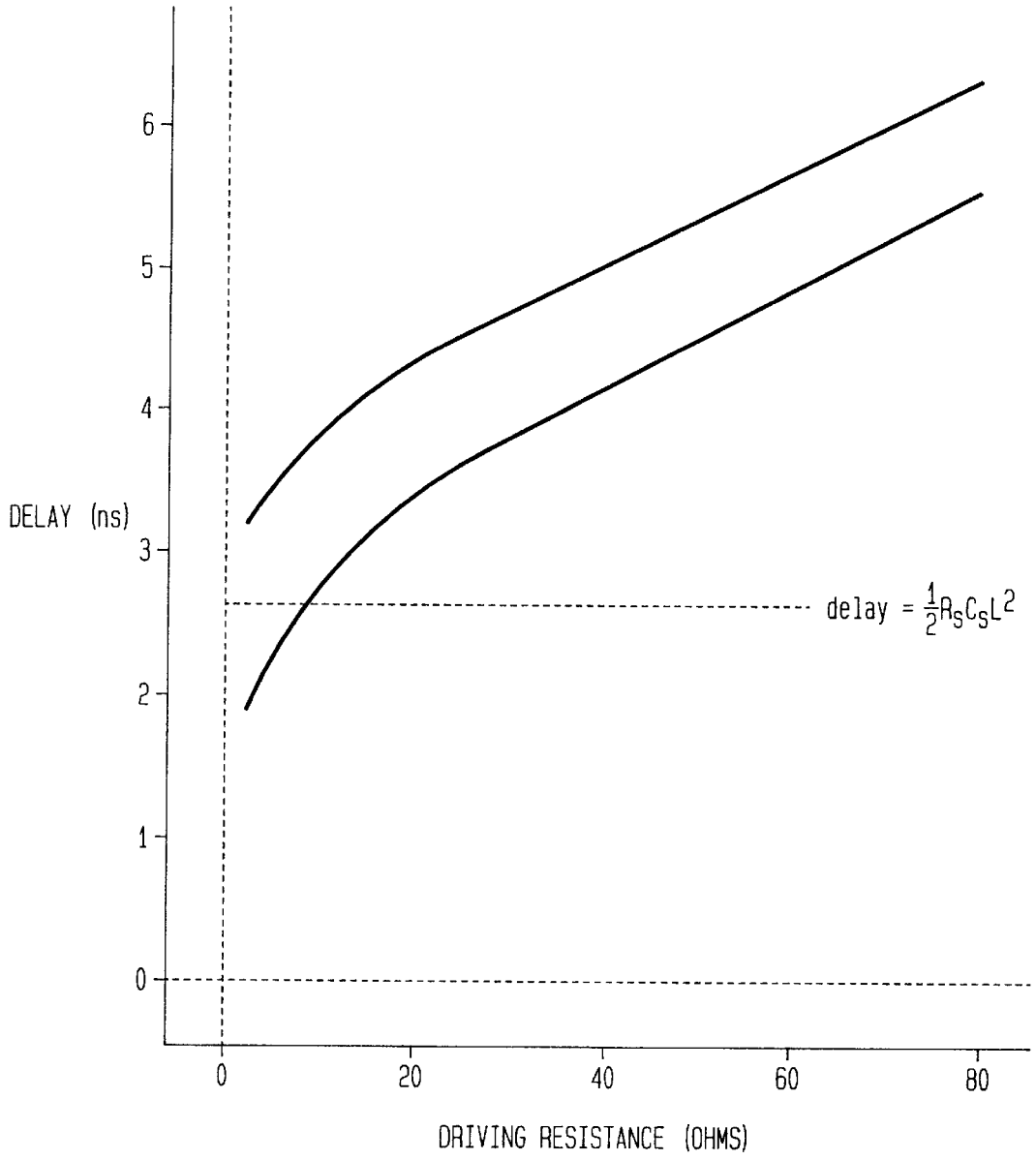
FIG. 6 is a plot of delay as a function of $R_0$ for optimal-width rectangular wire (top line) and optimally-tapered wire (bottom line)

FIG. 6 compares the delay of an optimal-width rectangular wire and the optimal taper as $R_0$ ranges from 2.5 to 80Ω. As $R_0$ gets smaller, the savings of the optimal taper over the optimal-width rectangular wire grows in absolute magnitude as well as in percentage.

Figure 7:
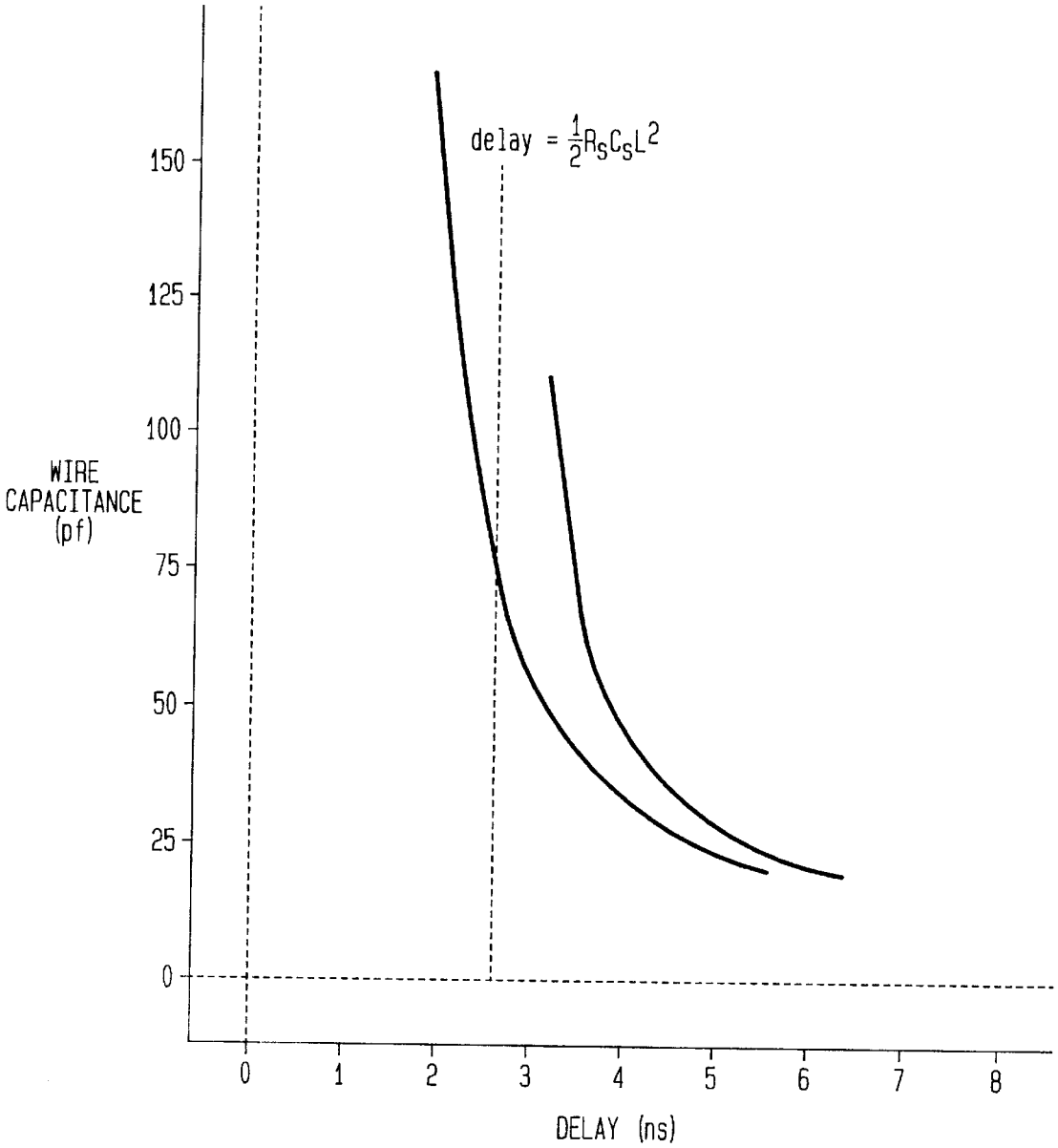
FIG. 7 shows delay-capacitance curves for optimal-width rectangular wire (right line) and optimally-tapered wire (left line).

The data for FIG. 7 were also generated by varying $R_0$ from 2.5 to 80Ω, but the total capacitance of each wire is plotted, instead of $R_0$. This graph thus shows the delay vs. power tradeoff that is offered by the optimal taper, as contrasted with the optimal-width rectangular wire. We can see that all the points on the curve for the optimal-width rectangular wire are inferior. At a given power, the optimal Elmore taper can always achieve less delay, and for a given delay can achieve less power.

The signal velocity in a conductor, which is due to distributed inductance and capacitance, cannot be greater than the speed of light divided by $\sqrt{\epsilon}$, where $\epsilon$ is the dielectric constant for the surrounding material. Aluminum wires in VLSI, however, are so thin that their RC delay far exceeds their LC delay. Therefore we have much room for decrease of delay within the RC model before LC considerations invalidate the assumptions made in that model. In contrast to the rectangular wire, which has an intrinsic RC delay that cannot be reduced no matter how much $R_0$ is reduced, the RC delay of an optimal tapered wire can be reduced below any given positive threshold, by driving it with a sufficiently low $R_0$ and tapering accordingly. Of course this is not free; We must use more power for the larger wire and the smaller $R_0$. But in cases where we might be willing to use this power, such as in a clock driver, the delay might be reduced so as to approach the LC limit.

In order to demonstrate that RC Elmore delay can be reduced below any given amount by tapering we will first consider the case $C_p=0$, then use this to prove the same result when $C_p>0$.

It has been demonstrated in applicants' aforementioned article of December 1995 that when perimeter capacitance is zero, the optimal taper is $$w(x)=\frac{2C_0}{C_sL}\,W\left(\frac{L}{2}\sqrt{\frac{R_sC_s}{R_0C_0}}\right)e^{2W\left(\frac{L}{2}\sqrt{\frac{R_sC_s}{R_0C_0}}\right)x/L} \tag{7}$$

This can be written in terms of the Elmore taper function as $$w(x)=E\left(\frac{2C_0}{C_sL}\,W\left(\frac{L}{2}\sqrt{\frac{R_sC_s}{R_0C_0}}\right),C_0,0,C_s,x\right)$$

In these expressions W is the inverse of the function $f(x)=xe^x$. W satisfies the equations $W(x)e^{w(x)}=x$, $W(xe^x)=x$, $W(0)=0$, and $W'(0)=1$. W(x) grows like log (x) as x goes to infinity. The delay for the optimal shape given in (7) is $$\frac{R_sC_sL^2\left(1+2W\left(\frac{L}{2}\sqrt{\frac{R_sC_s}{R_0C_0}}\right)\right)}{4W^2\left(\frac{L}{2}\sqrt{\frac{R_sC_s}{R_0C_0}}\right)} \tag{8}$$

Note that as $R_0$ goes to zero, (8) goes to zero, and the capacitance of the optimally-tapered wire goes to infinity.

By contrast, if the wire has constant width K, the delay is $$R_0C_0+KLR_0C_s+\frac{L}{K}R_sC_0+\frac{1}{2}R_sC_sL^2$$

$$K=\sqrt{\frac{R_sC_0}{R_0C_s}}$$

$$R_0C_0+2L\sqrt{R_0C_0R_sC_s}+\frac{1}{2}R_sC_sL^2$$

Notice that no matter how hard we drive the rectangular wire, its delay is always greater than $$\frac{1}{2}R_sC_sL^2$$

We can prove that the RC delay of a lead with $C_p>0$ can be reduced below any given value $\epsilon$, no matter how small, by reducing to the case $C_p=0$ as follows: Remove all the perimeter capacitance from the sides of the wire, and add it at the load end. Now we have a problem with zero perimeter capacitance and a fixed load capacitance (now equal to $C_0+C_pL$) which is the problem form addressable by the previous case. Thus there is an exponential taper which reduces the delay for this configuration below $\epsilon$. Keeping this exponential taper fixed, we redistribute the $C_pL$ part of the load back to the sides of the wire. This can only reduce the delay. Finally we change the taper from exponential to the optimal Elmore taper function that minimizes the delay with consideration of the perimeter capacitance. Since this is the optimal taper, its delay must be less than the previous exponential taper, and thus is less than $\epsilon$. This is illustrated in FIGS. 6 and 7, where the delay of the optimally-tapered wire, but not the rectangular wire, can be made less than $$\frac{1}{2}R_sC_sL^2.$$

Optimal taper delay is first-order immune to wire width variations. Fundamental to the derivation of Euler's equation is the condition that the integral being minimized must be stationary with respect to variations in the candidate function u(x). In other words, we suppose that the optimal function u(x) is perturbed by an error function $\eta(x)$, scaled by $\epsilon$ to produce $u(x)+\epsilon\eta(x)$. If we then regard the functions u and $\eta$ as fixed, and $\epsilon$ as variable, the value of the functional $$I=\int_{x_0}^{x_1}F(x,u(x)+\epsilon\eta(x),u'(x)+\epsilon\eta'(x))dx$$

becomes a function of $\epsilon$, and the fact that u(x) gives a minimum for I implies that the perturbed function $u(x)+\epsilon\eta(x)$ must have a minimum at $\epsilon=0$. Therefore it must be the case that $$\frac{dI}{d\epsilon}=0. \tag{9}$$

Equation (9) is the starting point from which Euler's differential equation is derived, and in our case express the condition that at the optimal wire shape, the first order variation of delay with respect to any wire-width variation is zero. In more practical terms, this means that if the optimal wire shape acquires a small bump (or narrowing) within any section along its length, then the extra delay caused by the bump capacitance, times the upstream resistance, is almost exactly cancelled by the decrease in delay due to the lowered resistance of that section, times all the downstream capacitance. Another practical consequence is that the discretization of the optimal wire taper, which is a continuous function, to multiples of the basic lithography quantum (which is 0.02 micron in the case of the representative 0.35-micron process) will have insignificant affect on delay.

The adequacy of an approximation to the design of Equation 5 can be judged by the extent to which the design achieves the minimal delays provided by this design. Given particular values of $C_0$, $C_p$, $C_S$, $R_S$, $R_0$ and L, there is a unique function w(x) which gives the smallest possible value for the Elmore delay in Equation (2). This function is also uniquely defined as the Elmore function $E(W_0, C_0, C_p, C_S, x)$, which is the derivative u'(x) of the solution u(x) to the differential equation (3) satisfying $u(0)=0$ and $u'(0)=W_0$, where the single parameter $W_0$ is set to the unique value that causes (2) to be a minimum. A third way to uniquely define this function is as the power series (5), where the single parameter $W_0$ is set to the unique value that causes (2) to be a minimum. These three definitions are equivalent; they define the same function. When we say that a given function f(x) is approximately equal to this optimum function $E(W_0, C_0, C_p, C_S, x)$, we mean that when f(x) is substituted for w(x) in Eq. (2), the resulting value of Elmore delay exceeds by less than 20% the minimum possible value produced by the substitution of $E(W_0, C_0, C_p, C_S, x)$ for w(x) in Equation (2).

Preferably it exceeds the minimum possible value by less than 10%, and even more preferably by less than 5%.

It is to be understood that the above-described embodiments and examples are illustrative of only a few of the many possible specific embodiments which can represent applications of the principles of the invention. Numerous and varied other arrangements can be devised by those skilled in the art without departing from the spirit and scope of the invention.

What is claimed is:

1. In an electrical circuit device comprising a substrate having a layer of dielectric material, a source of an electrical signal characterized by a driving resistance $R_0$, a load for receiving said signal characterized by a load capacitance $C_0$, and a conductive lead in contact with said dielectric layer extending along a length x measured from said load to said source, said lead characterized by an area capacitance $C_S$, a sheet resistance $R_S$ and a length L, the improvement wherein the width of said lead w(x) is the function of x given by:

$$w(x) = \frac{2C_0}{C_S L} W\left(\frac{L}{2}\sqrt{\frac{R_S C_S}{R_0 C_0}}\, e^{2W\left(\frac{L}{2}\sqrt{\frac{R_S C_S}{R_0 C_0}}\right)x/L}\right)$$

where W is the inverse of the function $xe^x$.

2. In an electrical circuit device comprising a substrate having a layer of dielectric material, a source of an electrical signal characterized by a driving resistance $R_0$, a load for receiving said signal characterized by a load capacitance $C_0$, and a conductive lead in contact with said dielectric layer connecting said source to said load, said lead characterized by a width $W_0$ at the load, an area capacitance $C_S$ and an extension along a length x measured from said load, the improvement wherein the width of said lead w(x) is a function of x given by:

$$w(x) \approx W_o + \frac{W_0(2C_S W_0)}{2C_0} x + \frac{Wo(4C_s^2 W_o^2)}{8C_o^2} x^2.$$

3. The device of claim 2 wherein said substrate comprises a semiconductor material.

4. The device of claim 2 wherein said device is a multichip module.

5. In an electrical circuit device comprising a substrate having a layer of dielectric material, a source of an electrical signal, a load for receiving said signal characterized by a load capacitance $C_0$ and a conductive lead in contact with said dielectric layer extending along a length x measured from said load to said source, said lead characterized by a width $W_0$ at the load, an area capacitance $C_S$, and a perimeter capacitance $C_p$, the improvement wherein the width of said lead w(x) is the function of x given by:

$$w(x) = W_0 + \frac{W_o(2C_S W_o + C_p)}{2C_o} x + \frac{W_o(4C_s^2 W_o^2 - C_p^2)}{8C_o^2} x^2 + \frac{W_o(8C_s^3 W_o^3 - 4C_s^2 W_o^2 C_p + 2C_S W_o C_p^2 + 3C_p^3)}{48C_o^3} x^3 + \frac{W_o(16C_s^4 W_o^4 - 16C_s^3 W_o^3 C_p + 8C_p^2 C_s^2 W_o^2 - 20C_S W_o C_p^3 - 15C_p^4)}{384C_o^4} x^4 + \frac{W_o(32C_s^5 W_o^5 - 48C_s^4 W_o^4 C_p + 48C_s^3 W_o^3 C_p^2 + 40C_s^2 W_o^2 C_p^3 + 210C_S W_o C_p^4 + 105C_p^5)}{3840C_o^5} x^5 + \ldots$$

6. In an electrical circuit comprising a substrate having a layer of dielectric material, a source of an electrical signal characterized by a driving resistance $R_0$, a load for receiving said signal characterized by a load capacitance $C_0$, and a conductive lead in contact with said dielectric layer connecting said source to said load, said lead characterized by a width $W_0$ at the load, an area capacitance $C_S$, a perimeter capacitance $C_p$ and an extension along a length x measured from said load, the improvement wherein the width of said lead line w(x) is a function of x given by:

$$w(x) \approx W_o + \frac{W_o(2C_S W_o + C_p)}{2C_o} x + \frac{W_o(4C_s^2 W_o^2 - C_p^2)}{8C_o^2} x^2.$$

7. The device of claim 5 or 6 wherein said substrate comprises a semiconductor material.

8. The device of claim 5 or claim 6 wherein said device is an integrated circuit.

9. The device of claim 5 or claim 6 wherein said conductive lead comprises aluminum.

* * * * *